US006752438B2

(12) United States Patent
DeSouza

(10) Patent No.: US 6,752,438 B2
(45) Date of Patent: Jun. 22, 2004

(54) ADJUSTABLE GATE HINGE AND LATCH, AND SYSTEM

(75) Inventor: Joseph DeSouza, North Royalton, OH (US)

(73) Assignee: U.S. Fence, LLC, Middleburg Heights, OH (US)

( * ) Notice: Subject to any disclaimer, the term of this patent is extended or adjusted under 35 U.S.C. 154(b) by 0 days.

(21) Appl. No.: 10/037,248

(22) Filed: Nov. 7, 2001

(65) Prior Publication Data

US 2002/0060460 A1 May 23, 2002

Related U.S. Application Data

(60) Provisional application No. 60/248,930, filed on Nov. 15, 2000.

(51) Int. Cl.[7] ..... E08C 3/14

(52) U.S. Cl. ..... 292/238; 292/341.18; 292/DIG. 60; 292/DIG. 13; 292/DIG. 29; 16/235; 256/73

(58) Field of Search ..... 292/238, 341.18, 292/341.19, DIG. 60, DIG. 13, DIG. 29; 16/237, 235, 238, 236, 86.1; 256/73, 65.13

(56) References Cited

U.S. PATENT DOCUMENTS

| | | | | | |
|---|---|---|---|---|---|
| 60,808 | A | | 1/1867 | Watson | |
| 376,027 | A | | 1/1888 | Claypool | |
| 764,144 | A | | 7/1904 | McGowan | |
| 2,615,194 | A | * | 10/1952 | Kreiner | 16/248 |
| 3,041,657 | A | | 1/1962 | McNinch | |
| 3,266,831 | A | | 8/1966 | Banse | |
| 3,433,518 | A | | 3/1969 | Foltz | |
| 3,938,219 | A | * | 2/1976 | Rock et al. | 16/238 |
| 3,952,366 | A | * | 4/1976 | Rock et al. | 16/235 |
| 4,035,093 | A | * | 7/1977 | Redshaw | 403/4 |
| 4,103,394 | A | | 8/1978 | Röck et al. | |
| 4,305,611 | A | | 12/1981 | Robins | |
| 4,690,440 | A | * | 9/1987 | Rogers | 292/54 |
| 4,871,203 | A | | 10/1989 | Rogers | |
| 4,938,508 | A | | 7/1990 | Thomas | |
| 4,993,759 | A | | 2/1991 | Thomas | |
| 5,078,438 | A | | 1/1992 | Bieganski | |
| 5,116,090 | A | * | 5/1992 | Nichandros | 292/236 |
| 5,199,218 | A | * | 4/1993 | McQuade | 49/381 |
| 5,498,041 | A | | 3/1996 | Bezzerides et al. | |
| 5,548,869 | A | | 8/1996 | Ryczek | |
| 5,592,717 | A | | 1/1997 | Longo | |
| 5,655,801 | A | | 8/1997 | Casey | |
| 5,868,446 | A | * | 2/1999 | Rossmo | 292/341.17 |
| 6,176,043 | B1 | * | 1/2001 | Gibbs | 49/501 |
| 6,353,966 | B1 | * | 3/2002 | King | 16/235 |
| 6,442,798 | B1 | * | 9/2002 | Rupprechter | 16/242 |

* cited by examiner

*Primary Examiner*—J. J. Swann
*Assistant Examiner*—Dinesh Melwani
(74) *Attorney, Agent, or Firm*—Pearne & Gordon LLP

(57) ABSTRACT

An adjustable gate hinge and an adjustable latch unit each provide for adjustment of a fence gate. The hinge interconnects the gate to a first post of the fence. The hinge supports the gate and permits pivoting movement of the gate relative to the first fence post. The latch unit secures the gate, to a second post of the fence, in a closed position of the gate. The hinge and the latch unit are usable together in a system. As such, the system has the feature that at least one of the hinge and the gate unit has an arrangement to permit adjustment of the gate relative to the fence in a direction perpendicular to a plane of the fence. The arrangement includes two components that are relatively movable along the direction perpendicular to a plane of the fence and that are secured to each other subsequent to the movement along the direction perpendicular to the plane of the fence.

8 Claims, 5 Drawing Sheets

ADJUSTABLE GATE HINGE AND LATCH, AND SYSTEM

This application claims the benefit of U.S. Provisional Patent Application No. 60/248,930, filed Nov. 15, 2000.

FIELD OF THE INVENTION

This invention relates generally to hinges and latches for use with fence gates and more particularly relates to hinges and latches that are adjustable for movement horizontally in a direction perpendicular to the plane of the gate to compensate for movement of the gate posts along the same direction.

BACKGROUND OF THE INVENTION

Fences made of wood or metal tend to be rather heavy. One concern for the hinges holding one side of a fence gate to a fence post and latch mechanism holding the other side of the gate to another fence post is the sagging of the gate and/or the fence posts as a result of the weight of the gate itself. To compensate for this, it has been recognized as desirable to allow adjustments to be built into the hinge, as shown in U.S. Pat. No. 60,808. Most efforts have generally gone into providing adjustability in the gate latch to compensate for sagging. For example, U.S. Pat. Nos. 3,433,518, 4,305,611, 5,498,041, and 5,655,801 show different ways of providing adjustability or adaptability in the latch such as by providing camming surfaces to move the gate up and down as the latch bar slides into the latch frame to bring the position of the frame back to the desired position of the frame back to the desired position when the gate is latched. Other efforts provided vertical adjustability to compensate or adjust for a sagging gate and its movement in a vertical plane.

However, with modern fencing, it has been found that adjustability of this type is not of the primary importance. Fences and gates can be built from materials as polyvinyl chloride or other plastic, which are lightweight and provide a high degree of rigidity so that the shape of the gate itself does not tend to change over a period of time. However, this has created a somewhat different problem. The posts on each side of the gate may tend to move in a direction perpendicular to the plane of the gate as may happen from loads of snow pushed against them by snow plows or other impacts even though the posts are set in the ground with concrete for a sufficient depth to go below the frost line.

If the gate posts are perfectly vertical, the hinges may be mounted on a perfectly vertical axis so that the gate hinge position is neutral, with a tendency neither to open nor close by the weight of the gate. However, it may be considered desirable to provide a positioning such that the gate tends to be self-closing or self-opening. To provide such positioning requires movement of at least one hinge axis to allow the gate to swing in the desired direction.

Movement of the hinge axes may result in a misalignment at the gate latch. The misalignment may be such that the latch may become difficult to operate because, as a result of the change in hinge position, the latch either may not allow the gate to close fully or may allow it to close past the desired middle position with respect to the adjacent post.

SUMMARY OF THE INVENTION

In accordance with one aspect, the present invention provides a novel hinge and latch arrangement that permits regulation and adjustment of a gate with respect to the gate posts by allowing adjustable movement in a direction perpendicular to the plane of the gate.

In accordance with another aspect of the present invention, the hinge is provided such that the location of a hinge pivot point can be adjusted and moved in a direction perpendicular to the plane of the gate by loosening a single fastener screw and sliding a portion of the hinge to a desired position after which the screw can be retightened to clamp the movable slide between a mounting bracket and a post.

In accordance with another aspect of the present invention, the hinge can be inverted to be used on either of two posts associated with the gate, and when mounted on an end surface face of a post, the hinge can be arranged to have a side extension to either the front or the back surface of the post.

In accordance with another aspect of the present invention, the latch unit is provided such that a latch pin can be adjustably moved horizontally to and from the gate to allow the gate to be centered with respect to the adjacent post when the latch unit is closed.

In accordance with another aspect of the present invention, the latch unit can be inverted and used on either side of the gate without modification.

In accordance with another aspect of the present invention, the latch unit is easily adaptable to allow actuation of the latch unit from the side of the gate opposite the latch pin.

In accordance with still another aspect, the present invention provides an adjustable gate hinge and latch system for a fence gate of a fence. A hinge interconnects the gate to a first post of the fence. The hinge supports the gate and permits pivoting movement of the gate relative to the first fence post. A latch unit secures the gate, to a second post of the fence, in a closed position of the gate. At least one of the hinge and the gate unit has an arrangement to permit adjustment of the gate relative to the fence in a direction perpendicular to a plane of the fence. The arrangement includes two components that are relatively movable along the direction perpendicular to a plane of the fence and that are secured to each other subsequent to the movement along the direction perpendicular to the plane of the fence.

In accordance with still another aspect, the present invention provides an adjustable gate hinge that has an arrangement to permit adjustment of the gate relative to the fence in a direction perpendicular to a plane of the fence.

In accordance with still another aspect, the present invention provides an adjustable latch unit that has an arrangement to permit adjustment of the gate relative to the fence in a direction perpendicular to a plane of the fence.

BRIEF DESCRIPTION OF THE DRAWINGS

Further features and advantages will become apparent to those skilled in the art upon reading the following detailed description taken with the accompanying drawings, in which.

DETAILED DESCRIPTION OF AN EXAMPLE EMBODIMENT

Figure 1:
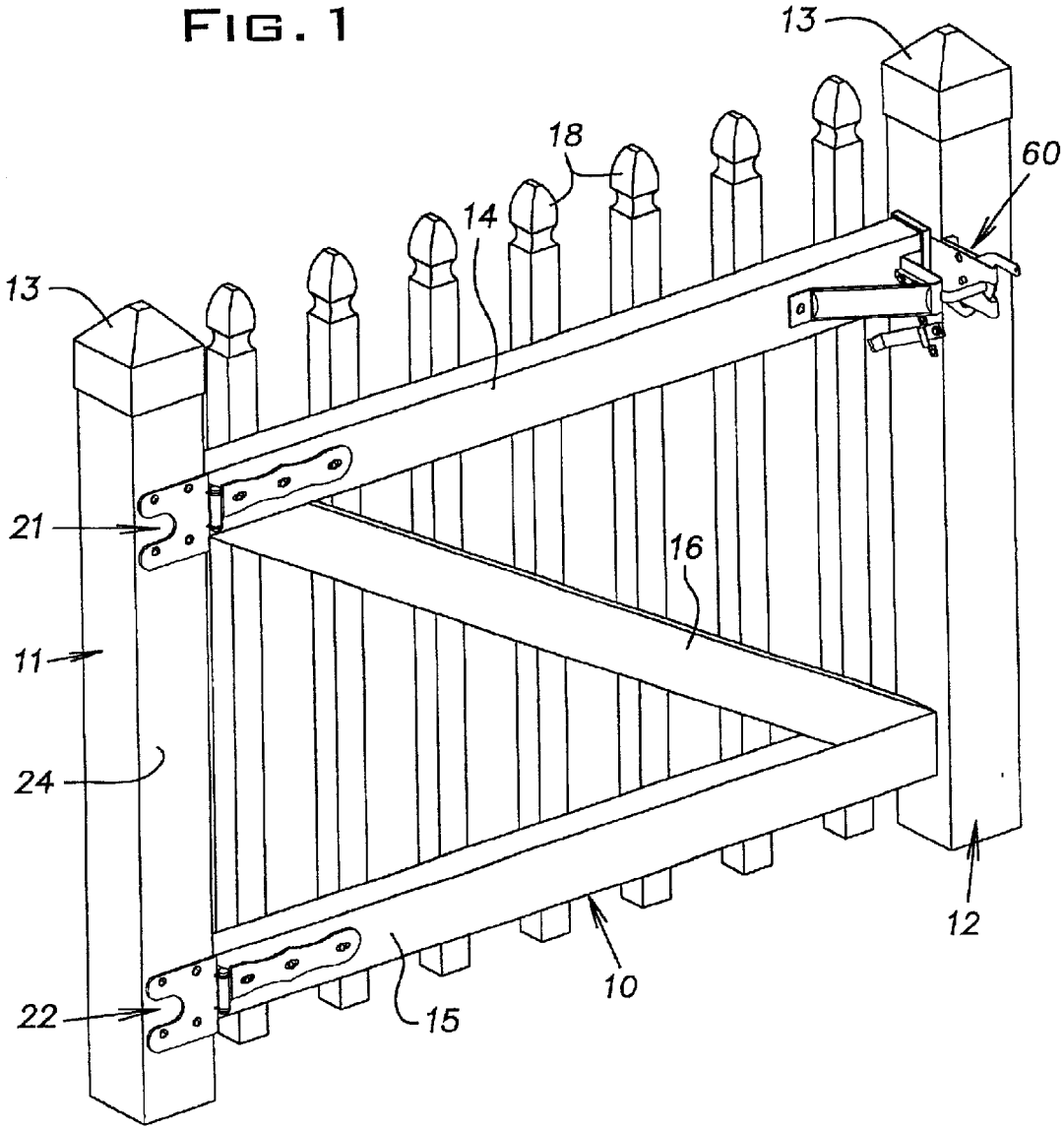
FIG. 1 is a perspective view of a gate mounted between a pair of gate posts using hinges and a latch unit in accordance with the present invention.
Figure 2:
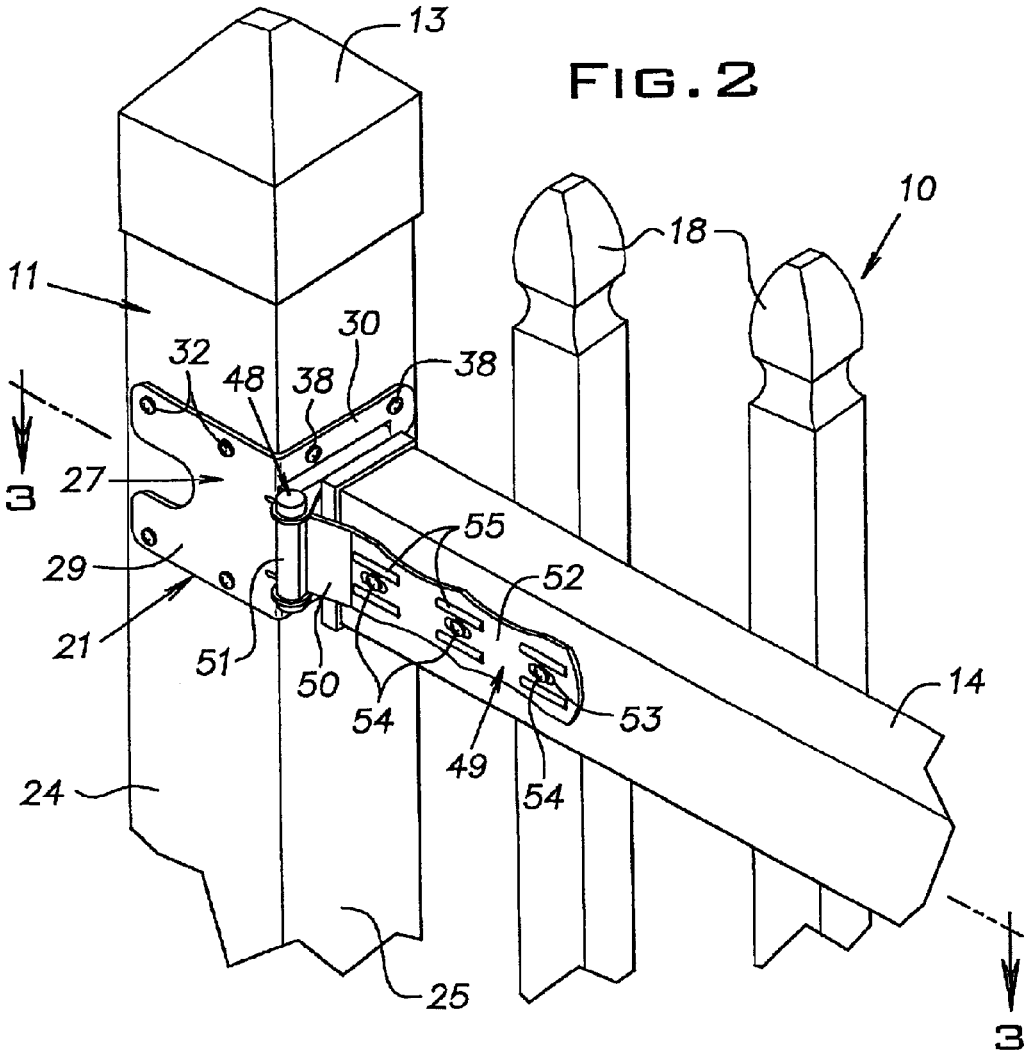
FIG. 2 is an enlarged perspective view showing detail of one of the hinges shown in FIG. 1.

Referring to the drawings in greater detail, FIG. 1 shows an example gate 10 mounted between two posts, such as hinge post 11 and latch post 12. Each of the posts 11, 12 has a cap 13 at an upper end. The gate 10 as shown may be constructed from an upper rail 14 and lower rail 15 as well as a diagonal reinforcing rail 16. On the one face of the gate suitable pickets or spindles 18 (FIG. 2) are secured to the rails 14, 15 to complete the structure of the gate itself.

Figure 3:
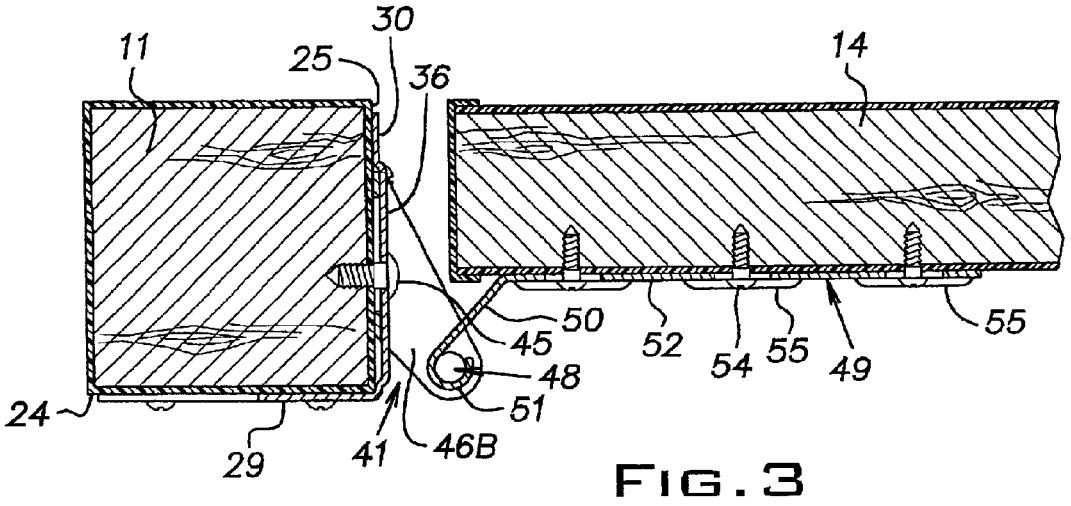
FIG. 3 is a cross-section view taken on lines 3—3 of FIG. 2 with certain parts removed for brevity.

In one example, all of the above parts are formed from extrusions of polyvinyl chloride and are held together either by suitable adhesives or mechanical fasteners. While the upper and lower rails 14 and 15, and pickets 18 may be hollow, it may be desirable to have the rails reinforced by wooden inserts (see FIG. 3) to better receive screw fasteners for hinges and a latch unit, as will be described in greater detail hereinafter. Also, each of the posts 11, 12 may be reinforced by an inner wood member extending into the ground, both to provide increased rigidity for mounting the gate and to receive the fasteners. The caps 13 (FIG. 1) add finish appearance and protect the inner wood members located within the posts 11, 12.

The gate 10 is mounted on the hinge post 11 by means of upper and lower hinges 21 and 22 that are identical in construction. For brevity, the upper hinge 21 will be described with the understanding that the description is applicable to the lower hinge 22.

The hinge post 11, which is typically square in cross section, has a face surface 24 extending generally parallel to the fence and the gate 10 and a side surface 25 (see FIG. 2) directly facing the gate. A hinge mounting bracket 27 of the upper hinge 21 is made of metal or other suitably strong material. The mounting bracket 27 is in the shape of a right angle having a face leg 29 abutting the face surface 24 and a side leg 30 abutting the side surface 25. The face leg 29 is of normal construction being flat and arranged with openings to receive fasteners 32 that extend into the hinge post 11.

Figure 4:
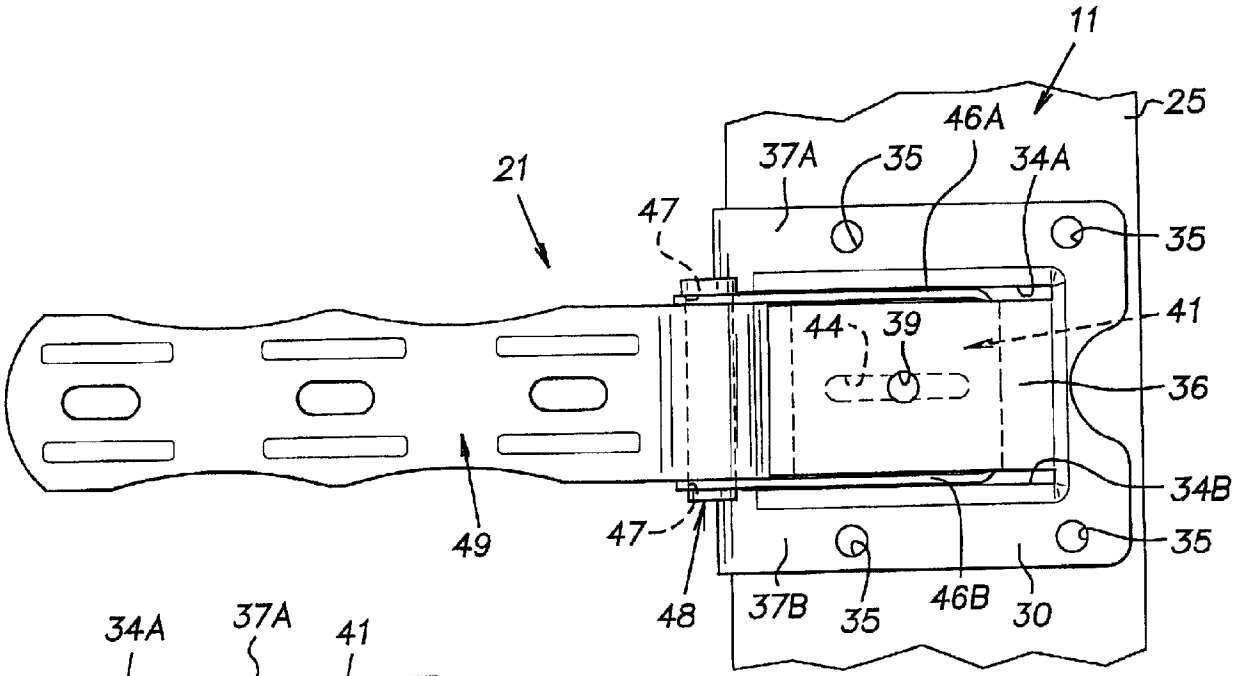
FIG. 4 is an elevation view of the hinge and a fragment of a post for reference, with the hinge assembly in an open position.

The side leg 30 of mounting bracket 27 is of different construction from the face leg 29. The side leg 30 has a pair of parallel, spaced horizontal slots 34A, 34B (FIG. 4) that define a center section 36 and upper and lower edge sections 37A, 37B. These edge sections 37A, 37B have openings 35 to receive fasteners 38 (not shown in FIG. 4, shown in FIG. 2) to secure the side leg 30 of the mounting bracket 27 to the side surface 25 of hinge post 11. The center section 36 (FIG. 3) is raised to be out of contact with the side surface 25. A fastener receiving hole 39 (FIG. 4) extends through the center section 36. A screw fastener 45 (not shown in FIG. 4, shown in FIG. 3) passes through the hole 39 into the hinge post 11.

Figure 5:
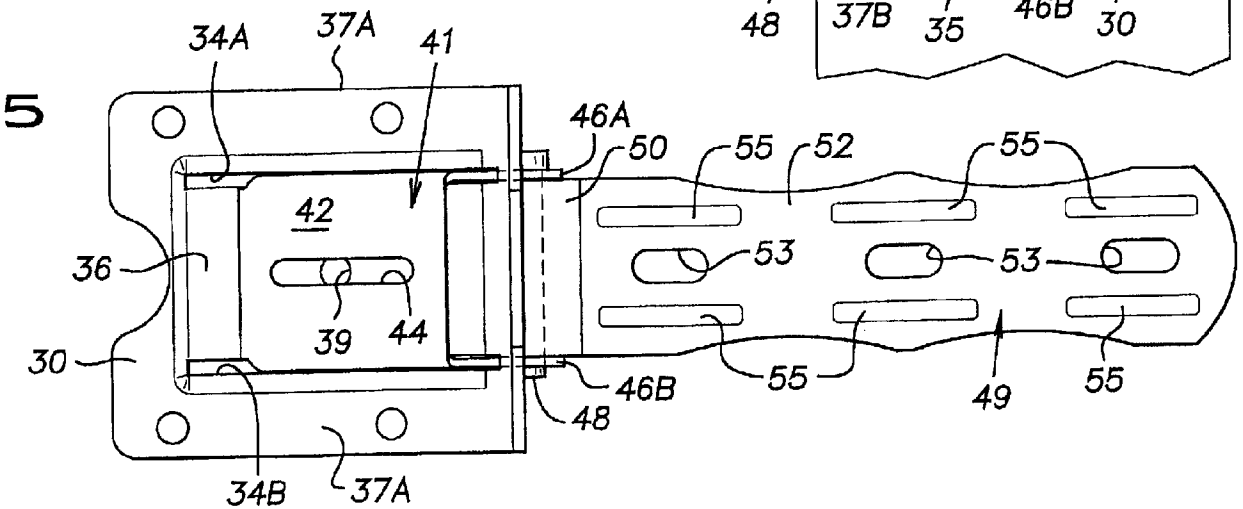
FIG. 5 is an elevation view of the hinge from the side opposite that shown in FIG. 4, with the post removed for clarity.

A slide member 41 (FIG. 5) is made of metal or other suitable material. The slide member 41 has a center section 42 positioned between the side surface 25 of the hinge post 11 (FIG. 4) and the raised center section 36 of the upper hinge 21. The center section 36 of the side leg 30 is spaced far enough away from the post side surface 25 that when the edge sections 37A, 37B are secured to the hinge post 11, the slide member 41 (FIG. 5) can be moved back and forth horizontally for hinge adjustment purposes.

The center section 42 of slide member 41 has an elongated slot 44 in alignment with the hole 39 in the center section 36 so that the screw fastener 45 (FIG. 3) passes through the hole 39 and slot 44 into the hinge post 11. When the fastener 45 is tightened, the slide member 41 is clamped in place by the center section 36. When the fastener 45 is loosened, the slide member 41 is free to move a distance determined by the length of slot 44.

The slide member 41 has a pair of ears 46A, 46B (FIG. 4) projecting from the upper and lower edges of center section 42 and extending perpendicular to the center section. The ears 46A, 46B extend horizontally through the slots 34A, 34B, respectively, past the center section 36 of the slide leg 30. Each of the ears 46A, 46B has an opening 47 therein. A hinge pin 48 extends vertically through the openings 47 of the ears 46A, 46B. In one example, the hinge pin 48 is non-rotatably connected to the slide member 41, either by being press-fit into the openings 47 of the ears 46A, 46B or by having the ends of the hinge pin formed to lock the hinge pin in place.

A hinge strap 49 (FIG. 5) is made from metal or other suitable material. An angled portion 50 (FIG. 3) of the hinge strap 49 extends from a generally flat portion 52. A portion extending from the angled portion 50 is rolled into a cylinder to form an eye 51 that journals the hinge strap 49 on the hinge pin 48.

The flat portion 52 (FIG. 2) extends along the adjacent upper rail 14 of the gate 10 and has elongated slot openings 53 (FIG. 5) to receive screws 54 (FIG. 3) that extend into the adjacent rail to hold the gate 10 relative to the hinge strap. If desired, suitable ridges 55 may be stamped in the flat portion 52 to provide additional stiffness. The elongated openings 53 allow the hinge strap 49 to be positioned (e.g., horizontally) with respect to the adjacent upper rail 14 so that the entire gate 10 can be moved to and from the hinge post 11 in the plane of the gate.

On the other hand, the construction and interaction of the mounting bracket 27 and slide member 41 provide for movement of the gate 10 in a direction perpendicular to the plane of the gate as may be required for balancing the mounting of the gate. The movement of the slides 41 of the two hinges 21, 22 (FIG. 1) provides that the gate 10 can be balanced in a neutral position or by movement of the slides to a different position, the gate can be biased by its weight to either swing toward the open position or the closed position as desired. The movement of the slide member 41 can provide the proper hinging action, even if the hinge post 11 is moved so it is no longer exactly perpendicular to the ground, as may happen if an excessive force is applied to the post for any reason.

The hinges 21, 22 can be used on either the left side or the right side of the gate 10 because the hinges are symmetrical about a horizontal centerline. As a result of the angled portion 50 (FIG. 3), the hinge strap 49 is able to rotate through a full range (e.g., 180 degrees) around the hinge pin 48 to allow the gate 10 to fold back against the fence portion next to the hinge post 11. Attendant with such features, the hinges 21, 22 can be mounted on either the inside or the outside of the hinge post 11, depending upon which direction is desired for the opening movement.

A latch unit 60 is positioned on the other side of the gate 10 from the hinges 21, 22. The latch unit 60 and latches the gate 10 to the latch post 12 and operates in a manner which, combined with the structure of the hinges 21 and 22, only allows the gate to open in one direction from the closed position.

The latch unit 60 (FIG. 6) includes a handle 61 that is made of metal or other suitable material. The handle 61 is mounted horizontally on the upper rail 14 and has a flat distal end portion 62 located away from the latch post 12. The end portion 62 is engaged against the upper rail 14.

An angled grip portion 64 extends from the end portion 62, and may be formed with a longitudinal indentation 65 to provide a rounded gripping surface on a side facing the gate 10. The grip portion 64 extends outward from the upper rail 14 to a bend 67. From the bend 67, a leg portion 69 of the handle 61 extends back toward the upper rail 14 of the gate 10. At an end of the leg portion 69, a bent mounting flange 71 abuts the upper rail 14.

Mounting holes (not visible in the Figures) extend through the end portion 62 and the mounting flange 71. Suitable screws 72 extend through the holes in the end portion 62 and the flange 71 to hold the handle 61 in position on the gate 10.

The leg portion 69 has a pair of horizontally aligned, elongated slots 74 (FIG. 7) as well as a hole or opening 76 at the bend 67. A latch pin 79 of the latch unit 60 is made of metal or suitable material. The latch pin 79 has a shank 81 (FIG. 6) extending through the hole 76 along the inside of the leg portion 69 of the handle 61. At least a portion of the shank 81 is flattened to provide a flattened portion 82 that enhances abutting contact with the leg portion 69 of the handle 61.

Figure 6:
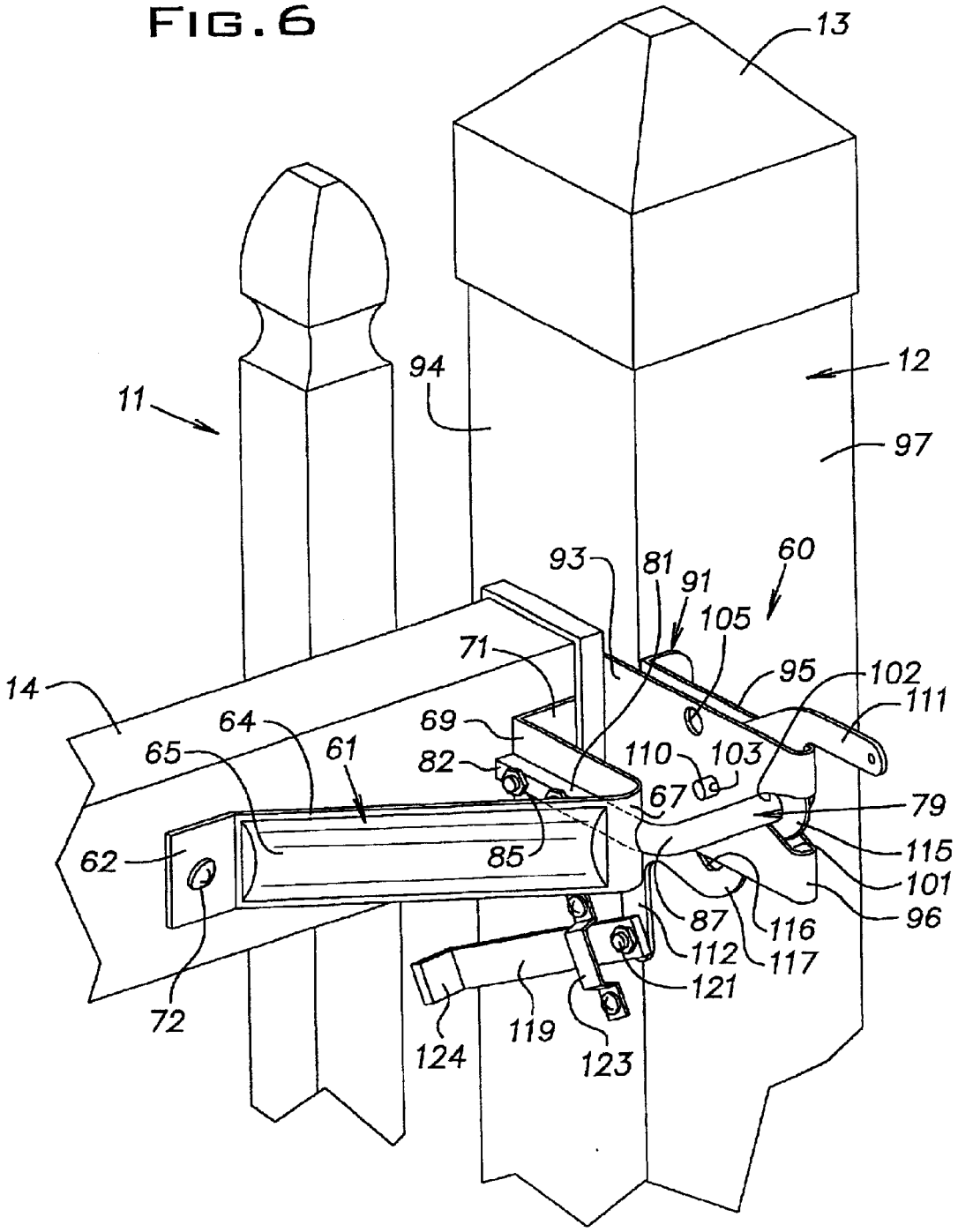
FIG. 6 is an enlarged perspective view showing details of the gate latch unit of FIG. 1.

Screws 84 (FIG. 7) extend through the slots 74 from the outer surface of the leg portion 69 and through suitable opening (not visible in the drawings) in the flattened portion 82 of the shank 81. The screws 84 receive nuts 85 (FIG. 6). When the nuts 85 are tightened, the shank 81 is clamped tightly to the inside of the leg portion 69. When the nuts 85 are loosened, the screws 84 are movable along the slots 74 and permit a limited amount of horizontal movement of the latch pin 79 with respect to the handle 61.

The latch pin 79 has a latch bar portion 87 extending at a right angle to the shank 81 parallel to the upper gate rail 14. The latch bar portion 87 terminates in an enlarged ball end 88 (FIG. 7).

The latch unit 60 includes a latch mounting bracket 91 attached to latch post 12. The mounting bracket 91 is made of metal or suitable material. The mounting bracket 91 includes an inner segment 93 and a parallel outer segment 95, connected together at a distal end by a bend 96. The inner segment 93 and the outer segment 95 are a spaced distance apart determined by the shape of the bend 96.

The inner segment 93 extends partially along an adjacent side surface 94 (FIG. 6) of the latch post 12. A flange portion 98 (FIG. 7) extends from the outer segment 95 and extends along a face surface 97 of the latch post 12. Suitable screws 99 extend through the flange portion 98 and inner segment 93 (not readily visible in FIG. 7) to mount the latch mounting bracket 91 in place on the latch post 12. At the distal end, the inner and outer segments 93 and 95 are cut away to form a generally V-shaped groove 101 extending back from the bend 96. The V-groove 101 terminates in a rounded root 102 having the same radius as the latch bar portion 87 of the latch pin 79.

Figure 7:
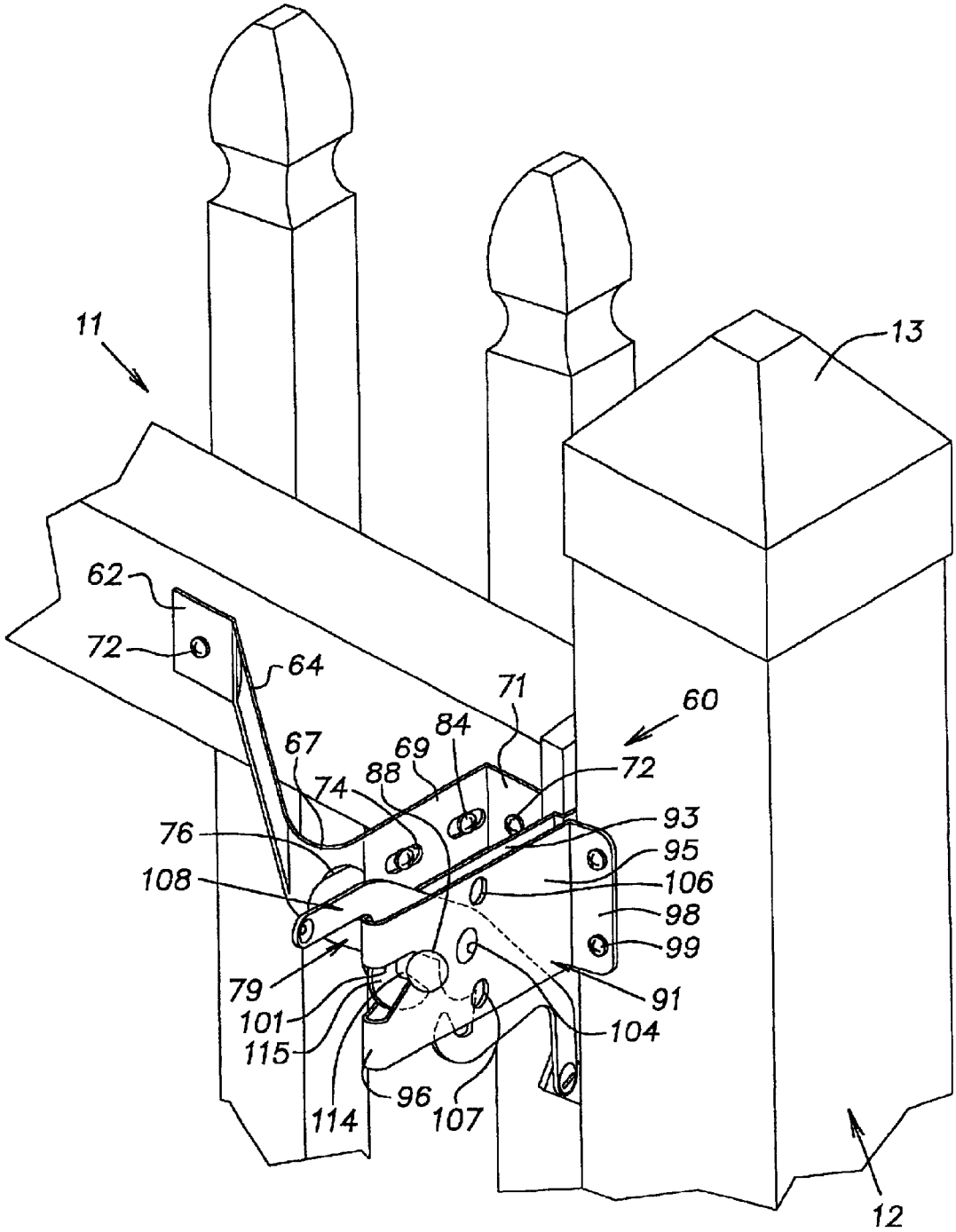
FIG. 7 is an enlarged perspective view of the gate latch unit showing the other side of the latch unit from that shown in FIG. 6.

Pivot holes 103 and 104 extend through the inner and outer segments 93 and 95, respectively (see FIGS. 6 and 7). The pivot holes 103 and 104 are in axial alignment with each other and are spaced a distance back from the V-groove 101. A pair of lock holes 105 and 106 (see FIGS. 6 and 7) extend through the inner and outer segments 93 and 95, respectively. The lock holes 105 and 106 are in axial alignment with each other and are located above the pivot holes 103 and 104. A lock (not shown) can be received in the first pair of lock holes to prevent the gate 10 from being opened. Another pair of lock holes (only 107 visible, FIG. 7) extend through the inner and outer segments 93 and 95. As shown in the mounting configuration of the Figures, the other pair of lock holes is below the pivot holes 103 and 104. If the latch unit 60 were mounted for an oppositely opening gate, the second pair of holes could be employed for receiving a lock. As such, the latch mounting bracket 91 is symmetrical about a horizontal centerline.

A catch member 108 has a center pivot hole (not visible). A pivot pin 110 (FIG. 6) extends through the pivot hole of the catch member and into the pivot holes 103 and 104. The catch member 108 is positioned between the inner and outer segments 93 and 95 of the latch mounting bracket 91 and is pivotally mounted on the pivot pin 110 relative to the latch mounting bracket.

The catch member 108 is symmetrical about a horizontal centerline passing through the pivot hole to have an upper arm 111 and a lower arm 112 extending above and below, respectively, the latch mounting bracket 91. The upper arm 111 has a curved upper hook 115 defining an upper notch opening 114. The lower arm 112 has a curved lower hook 117 defining a lower notch opening 116. The arms 111, 112 curve toward the same direction, away from the latch post 12.

The center of gravity of the entire catch member 108 is located between the pivot pin 110 and the root 102 of V-groove 101 due to the curvature of the upper and lower arms 111 and 112 in the same direction. In the absence of any applied force, the upper arm 111 pivots in the direction away from the latch post 12. With the upper arm 111 pivoted away from the latch post 12, the upper arm hook 115 extends over and encloses the latch bar portion 87 when the gate 10 is in the closed position. This arrangement allows the latch unit 60 to be opened, thus permitting the gate 10 to be opened, by merely manually raising the projecting end of the upper arm 111.

Both the upper and lower hooks 115 and 117 have a curved outer surface that cooperates with the V-groove 101 to allow the catch member 108 to pivot open when the latch pin 79 is moved into the V-groove 101. With the latch bar portion 87 in the V-groove 101, the catch member 108 pivots back downwardly so that the latch pin 79 is secured within the root 102 of V-groove 101 and within the notch opening 114 on the upper hook 115.

Moreover, with the latch mounting bracket 91 and the catch member 108 both vertically symmetrical (i.e., symmetrical about a horizontal line) about the pivot connection between them, the latch unit 60 is easily adapted for reversal and use for an oppositely swinging gate. Thus, the latch unit 60 can be used on either the right side or the left side of the gate 10. This feature is in corollary with the feature that the hinges 21, 22 can be used on either the left or right side of the gate 10.

To allow the gate 10 to be easily opened from the side opposite that having the bulk of the latch unit 60, a release bar 119 may be provided. The release bar 119 is located adjacent to the side surface 94 of the latch post 12, and is held in place by a bracket 123 secured to the side surface. The release bar 119 is located below the bulk of the latch unit

60, and is connected by a pivot bolt 121 to an end of the lower arm 112 of the catch member 108. The release bar extends to the opposite side of the fence.

A flat end 124 may be provided on the release bar 119 (i.e., on the opposite side) to permit easy manipulation. The release bar 119 is manually actuatable from the opposite side. In operation, the release bar 119 slides relative to the latch post 12 and bracket 123 to transmit force (i.e., a push force) to the lower arm 112. The force pivots the catch member 108 upward. The pivot bolt 121 permits some relative movement between the release bar 119 and the catch member 108.

Associated with the aspect of each of the hinges (e.g., 21) being adjustable to allow a certain amount of horizontal movement of the hinge pin 48 with respect to the adjacent hinge post 11, the latch unit 60 also accommodates horizontal movement. Reposition of the latch pin 79 with respect to the handle 61, by releasing the screws 84 and retightening them when the latch pin is in the desired position, provides the horizontal adjustment aspect. This arrangement allows a unique adjustment for the gate 10 at both the hinges 21, 22 and the latch unit 60 to permit adjustable movement of the gate with respect to the posts 11, 12 in a horizontal direction or one that is perpendicular to the plane of the gate.

From the above description of the present invention, those skilled in the art will perceive improvements, changes, and modifications. Such improvements, changes, and modifications within the skill of the art are intended to be covered by the appended claims.

What is claimed is:

1. An adjustable gate hinge and latch system for a fence gate of a fence, the system including:

a hinge to interconnect the gate to a first post of the fence, the hinge supporting the gate and permitting pivoting movement of the gate relative to the first fence post; and a latch unit to secure the gate to a second post of the fence in a closed position of the gate, said first and second posts defining a generally vertical plane of said fence; wherein the latch unit has an arrangement to permit adjustment of the gate relative to the fence in a direction perpendicular to the plane of the fence when said gate is in the closed position and the arrangement includes a gate handle adapted to be fixedly attached to the gate, and a latch pin slidably movable along the gate handle in the direction perpendicular to the plane of the fence, the gate handle and the latch pin being secured to each other subsequent to the movement along the direction perpendicular to the plane of the fence, one of the gate handle and the latch pin having an elongate slot and the other of the gate handle and the latch pin having an opening, a fastener extending through the slot and the opening, and the fastener being loosened to permit the relative movement of the gate handle and the latch pin and being tightened to secure the gate handle and latch pin to each other.

2. A system as set forth in claim 1, wherein the latch unit includes a portion attached to the second post, the latch pin has a latch bar portion, the latch bar portion cooperates with the attached portion of the latch unit to secure the gate in the closed position, and the latch bar portion is displaced in the direction perpendicular to the plane of the fence during the relative movement of the gate handle and the latch pin.

3. A system as set forth in claim 1, wherein the gate handle has a portion that extends in the direction perpendicular to the plane of the fence, the latch pin has a portion that extends in the direction perpendicular to the plane of the fence, and during the relative movement of the gate handle and the latch pin the portion of the latch pin is moved along the portion of the handle.

4. A system as set forth in claim 3, wherein the gate handle has an opening, the portion of the latch pin is moved through the opening of the latch handle.

5. An adjustable gate latch system for a fence gate of a fence, said fence having a first and a second post, the system including: a latch unit to secure the gate to the second post of the fence in a closed position of the gate, said first and second posts defining a generally vertical plane of said fence; wherein the latch unit has an arrangement to permit adjustment of the gate relative to the fence in a direction perpendicular to the plane of the fence when said gate is in the closed position and the arrangement includes a gate handle adapted to be fixedly attached to the gate, and a latch pin slidably movable along the gate handle in the direction perpendicular to the plane of the fence, the gate handle and the latch pin being secured to each other subsequent to the movement along the direction perpendicular to the plane of the fence, one of the gate handle and the latch pin having an elongate slot and the other of the gate handle and the latch pin having an opening, a fastener extending through the slot and the opening, and the fastener being loosened to permit the relative movement of the gate handle and the latch pin and being tightened to secure the gate handle and latch pin to each other.

6. A system as set forth in claim 5, wherein the latch unit includes a portion attached to the second post, the latch pin has a latch bar portion, the latch bar portion cooperates with the attached portion of the latch unit to secure the gate in the closed position, and the latch bar portion is displaced in the direction perpendicular to the plane of the fence during the relative movement of the gate handle and the latch pin.

7. A system as set forth in claim 5, wherein the gate handle has a portion that extends in the direction perpendicular to the plane of the fence, the latch pin has a portion that extends in the direction perpendicular to the plane of the fence, and during the relative movement of the gate handle and the latch pin the portion of the latch pin is moved along the portion of the handle.

8. A system as set forth in claim 7, wherein the gate handle has an opening, the portion of the latch pin is moved through the opening of the latch handle.

* * * * *